US005501621A

United States Patent [19]

Shigedomi et al.

[11] Patent Number: 5,501,621

[45] Date of Patent: Mar. 26, 1996

[54] OUTBOARD ENGINE STRUCTURE

[75] Inventors: Hideo Shigedomi; Kaoru Ichihashi; Hiroyuki Yoshida, all of Wako, Japan

[73] Assignee: Honda Giken Kogyo Kabushiki Kaisha, Tokyo, Japan

[21] Appl. No.: 277,065

[22] Filed: Jul. 19, 1994

[30] Foreign Application Priority Data

Jul. 20, 1993 [JP] Japan ..... 5-039473 U

[51] Int. Cl.[6] ..... B63H 21/38

[52] U.S. Cl. ..... 440/52; 440/88; 440/900

[58] Field of Search ..... 440/53, 52, 900, 440/88, 76–78; 123/195 P; 184/1.5

[56] References Cited

U.S. PATENT DOCUMENTS 4,588,385 5/1986 Suzuki ..... 440/88

5,180,319 1/1993 Shiomi ..... 440/52

5,199,914 4/1993 Marsh ..... 440/88

*Primary Examiner*—Edwin L. Swinehart

*Attorney, Agent, or Firm*—Armstrong, Westerman, Hattori, McLeland & Naughton

[57] ABSTRACT

An extension case in which an oil pan is accommodated includes on its left and right side surfaces mount receiving recesses for receiving a pair of lower mounts, respectively, and further an oil drain recess on the right side surface to which a drain bolt is exposed for draining oil from the oil pan. The oil drain recess is formed upwardly of the right mount receiving recess with a partition wall interposed therebetween and these recesses are opened at the right side surface of the extension case. When the extension case is produced by casting with two die parts which are divided into left and right sides, the arrangement makes it possible to form both the recesses simultaneously with use of one of the die parts.

26 Claims, 8 Drawing Sheets

OUTBOARD ENGINE STRUCTURE

BACKGROUND OF THE INVENTION

1. Field of the Invention

The present invention relates to an outboard engine structure having an oil pan accommodated inside an extension case.

2. Description of the Related Art

Outboard engine structures with a four-stroke cycle engine mounted thereon are grouped into two types: one having its oil pan formed integrally with one of outer wall defining members of the outboard engine structure such as an extension case; and another having an oil pan formed separately from such outer wall defining member and accommodated inside the latter.

Japanese Utility Model Application Laid-open No. 49199/91 (No. 3-49199) has made known an outboard engine structure of the type wherein an oil pan is formed separate from an extension case and accommodated within the case. In this known engine structure, a recess portion is formed at the rear of the extension case and a drain passage for the oil pan is exposed to the recess portion. Draining of oil is conducted by drawing off a bolt mounted within the recess portion.

When casting an extension case used in an outboard engine structure from aluminum alloy material, generally a casting die is formed of two die parts which are divided into left and right sides. In case of the aforementioned conventional outboard engine structure, however, the recess portion formed at the rear of the extension case has left and right side walls and is opened rearwardly, so that a rear side die part is required in addition to the left and right side die parts, this providing a problem that die parts must be divided in a complicated fashion and hence it results in a high cost.

Moreover, since the recess portion is provided at the rear of the extension case, it cannot be directed toward the ship body side even after steering the outboard engine structure to the maximum so that the operation of draining oil is difficult to be done from an on-board position. Furthermore, if a tool is used to loosen the drain bolt for draining of the oil from the oil pan, the tool may undesirably be contaminated with the oil discharged through a bolt hole.

SUMMARY OF THE INVENTION

The present invention has been proposed in view of the above circumstances and an object thereof is to provide an outboard engine structure whose extension case can easily be molded. Another object of the invention is to provide an outboard engine structure in which the operation of removing oil from the oil pan is conducted easily.

In order to achieve the above objects, according to the present invention, there is provided an outboard engine structure comprising an engine, a case for carrying said engine on an upper portion thereof, an oil pan which is accommodated inside an extension case forming at least a part of said case and which lubricates said engine, a drain passage for draining oil from said oil pan, a drain passage opening and closing means for opening and closing said drain passage, and a pair of left and right mounts for carrying said extension case on a swivel case against vibration, wherein a mount receiving recess for receiving at least a part of one of said left and right mounts and an oil drain recess to which said drain passage opening and closing means is exposed are formed and opened in the same direction on a side surface on one of left and right sides of said extension case.

With the arrangement described above, a casting die used for casting the extension case can be formed of two die parts which are divided into left and right sides and the mount receiving recess and the oil drain recess can be formed simultaneously in a casting process by using one of the parts. Moreover, if the outboard engine structure is steered, the oil drain recess which is formed on one side surface of the extension case is directed toward the ship body side so that the drain passage opening and closing means can be operated from an on-board position to complete the oil draining operation. During this operation, the oil drain recess can be directed downwardly by tilting up the outboard engine structure whereby the oil can swiftly be discharged to the outside without permitting the oil to be adhered to the outboard engine structure.

Furthermore, according to the present invention, there is provided an outboard engine structure comprising an engine, an oil pan for storing oil lubricating said engine, a drain passage for draining the oil from said oil pan, and a drain passage opening and closing means for opening and closing said drain passage, wherein an operating portion for operating said opening and closing means is disposed at a position remote from a path through which the oil to be drained from said drain passage flows.

With the above arrangement, when the operating portion is operated to release the drain passage opening and closing means for draining of the oil, a tool is not contaminated with the oil to be discharged through the drain passage, this contributing to enhancing the working efficiency.

The above and other objects, features and advantages of the present invention will become apparent from the following description of preferred embodiments taken in conjunction with the accompanying drawings.

Incidentally, the expressions "front", "rear", "front-and-rear direction" and the like terms used herein should be understood to be in alignment with the front and rear direction of the ship body or hull to which an outboard engine structure is associated and mounted in use.

BRIEF DESCRIPTION OF THE DRAWINGS

FIGS. 1–3 show a first preferred exemplary embodiment of the present invention, in which FIG. 1 is a whole side view of the outboard engine structure, FIG. 2 is an enlarged sectional view taken along a line 2—2 in FIG. 1 and FIG. 3 is a sectional view taken along a line 3—3 in FIG. 2.

FIGS. 2–8 show a second embodiment of the present invention, in which FIG. 4 is a whole side view of the outboard engine structure, FIG. 5 is an enlarged sectional view taken along a line 5—5 in FIG. 4, FIG. 6 is a sectional view taken along a line 6—6 in FIG. 5, FIG. 7 is a sectional view taken along a line 7—7 in FIG. 6 (with a gear case 10 being omitted therefrom) and FIG. 8 is a sectional view taken along a line 8—8 in FIG. 5.

DESCRIPTION OF PREFERRED EMBODIMENTS

A first embodiment according to the invention will first be described hereinafter with reference to FIGS. 1–3.

Figure 1:
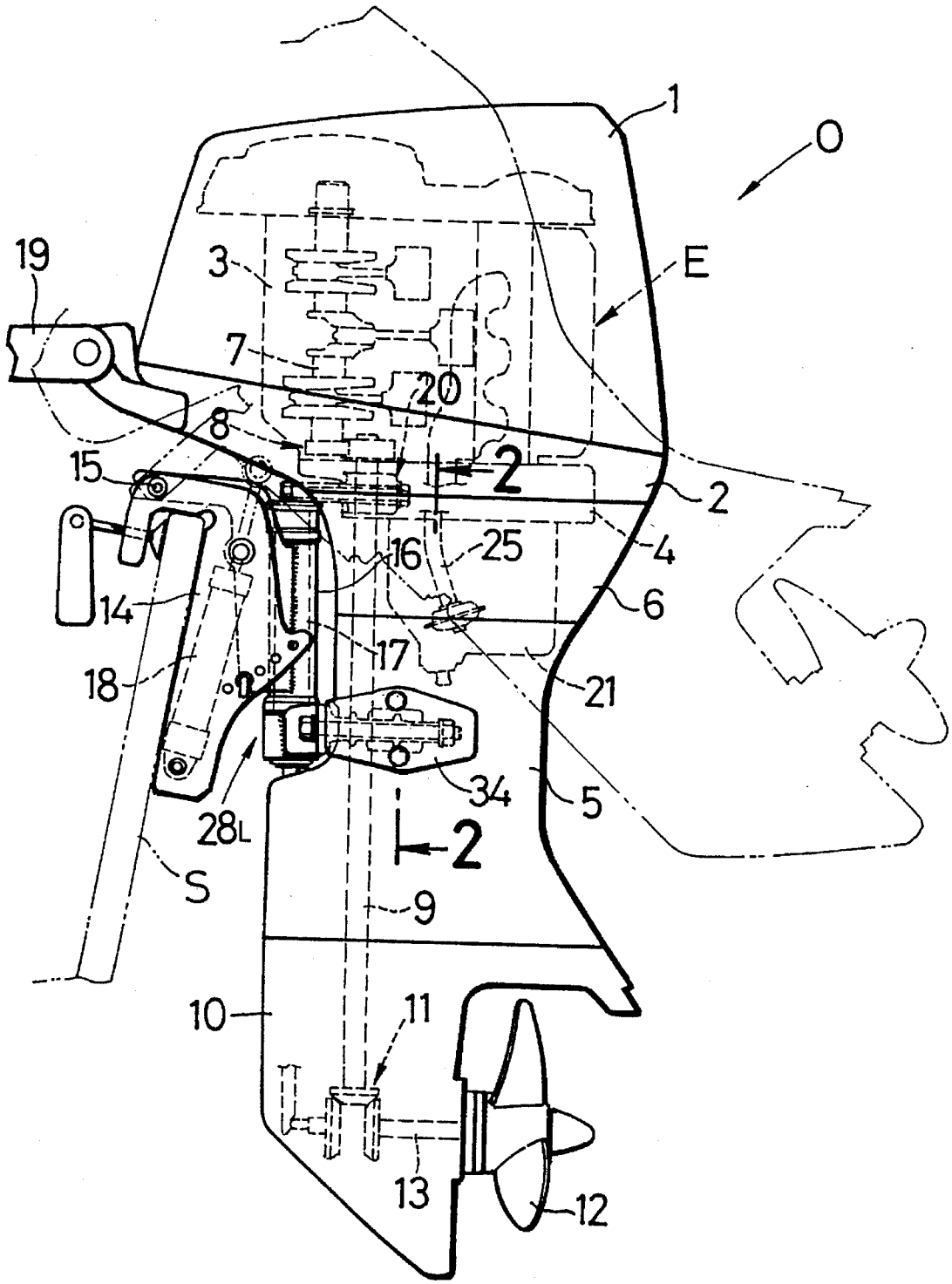

As shown in FIG. 1, an outboard engine structure O has a vertical type three-cylinder engine E mounted at an upper portion thereof. Upper and lower portions of the engine are covered with an engine cover 1 and an under case 2 which are provided separable from each other. To a lower surface of an engine block 3 is connected, via a joint member 4, an upper surface of an extension case 5. The extension case 5 is covered at its upper portion with an under cover 6 which is carried on a lower portion of the under case 2. The engine E has a crankshaft 7 which is connected at a lower end thereof with a drive shaft 9 via a reduction mechanism 8. The drive shaft 9 extends downwardly inside the extension case 5 and is connected, via a bevel gear mechanism 11 disposed inside a gear case 10, to a propeller shaft 13 which has a propeller 12 at a rear end thereof. The under case 2, joint member 4, extension case 5 and gear case 10 together form a case according to this embodiment.

A stern bracket 14 is detachably fixed to a ship body or hull S and a swivel case 16 is pivoted to the stern bracket 14 via a laterally extending tilt shaft 15 for vertical swinging motion. The outboard engine structure O is pivoted to the ship body S for lateral swinging motion by means of a swivel shaft 17 which extends vertically through the swivel case 16. The outboard engine structure O is accordingly capable of tilting up from a solid line position to a chain line position by driving and expanding a cylinder 18 which is mounted between the stern bracket 14 and swivel case 16. The outboard engine structure O is further capable of being steered to the left and the right by operating a steering lever 19 provided on the under case 2.

Figure 2:
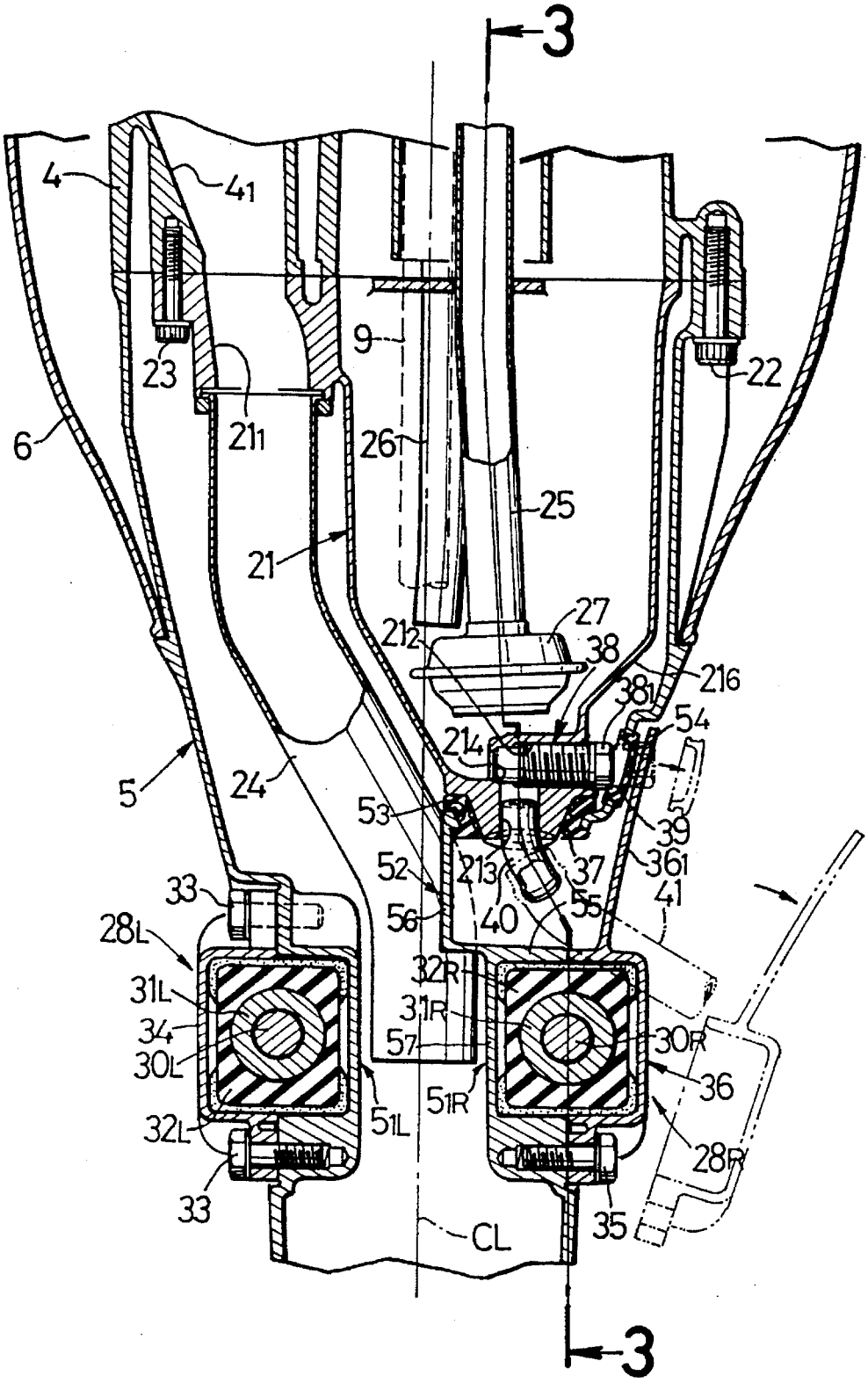
Figure 3:
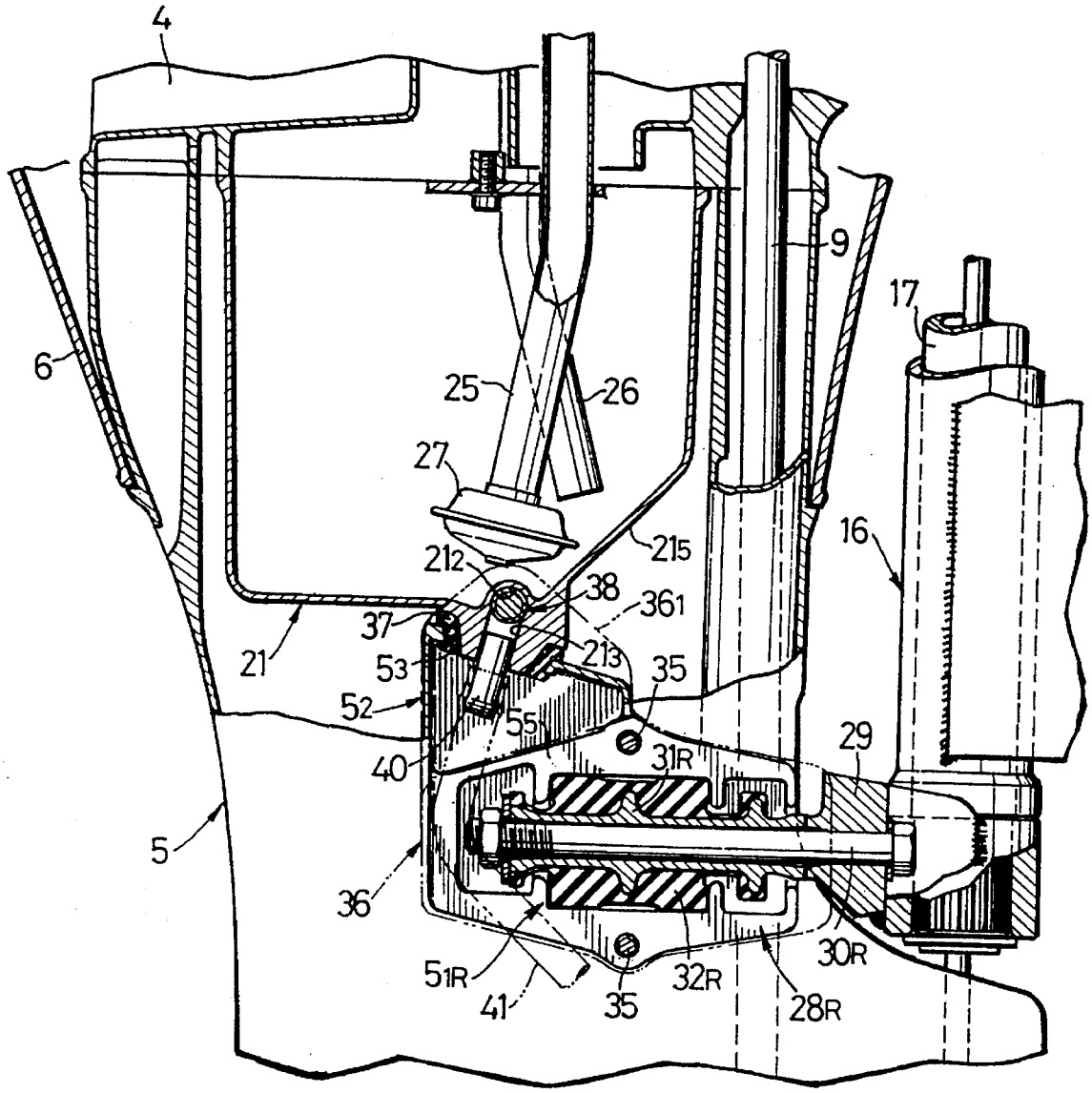

As is apparent from additional reference to FIGS. 2 and 3, the extension case 5 and an oil pan 21 are fixed to a lower surface of the joint member 4 via bolts 22 . . . , 23 . . . , respectively. The oil pan 21 is fitted inside the extension case 5 such that it is offset from a center line CL of the extension case 5 toward one lateral side (right side in FIG. 2), and in a space provided on the other side, i.e., left side, there is disposed an exhaust pipe 24 which is connected at its upper end to an exhaust passage at $4_1$ formed in the joint member 4 and an exhaust passage $21_1$ formed integrally in a bulged portion of a mounting flange of the oil pan 21 and which opens at its lower end to the interior of the extension case 5. The exhaust gas which is discharged from the exhaust pipe 24 to the inside of the extension case 5 is passed through a hollow interior of the propeller 12 into the water. An oil supply pipe 25 for supplying oil to the engine E and an oil returning pipe 26 for returning oil from the engine E are opened to the inside of the oil pan 21 and a strainer 27 is provided at the lower end of the oil supply pipe 25.

The swivel shaft 17 which is fitted inside the swivel case 16 is carried resiliently at its upper end on the joint member 4 via an upper mount 20 and at its lower end on left and right side surfaces of the extension case 5 via a pair of left and right lower mounts $28_L$, $28_R$. The lower mounts $28_L$, $28_R$ comprise a stay 29 spline-connected to the lower end of the swivel shaft 17, a pair of bolts $30_L$, $30_R$ extending through left and right side portions of the stay 29 in the front-and-rear direction, and rubber bushes $32_L$, $32_R$ which are fitted over outer peripheries of the bolts $30_L$, $30_R$ via collars $31_L$, $31_R$.

One rubber bush $32_L$ on the left side is fitted in a mount receiving recess $5_{1L}$ which is formed on the left side surface of the extension case 5 and the opening defined by the recess $5_{1L}$ is covered with a left cover 34 which is fixed to the left side surface of the extension case 5 in a detachable fashion by means of two bolts 33, 33. On the other hand, the rubber bush $32_R$ on the right side is fitted in a mount receiving recess $5_{1R}$ formed on the right side surface of the extension case 5 and its opening is covered with a right cover 36 which is fixed detachably to the right side surface of the extension case 5 by means of two bolts 35, 35.

The lower end of the afore-mentioned exhaust pipe 24 is situated between the left and right mount receiving recesses $5_{1L}$, $5_{1R}$ so that for avoiding interference with those recesses $5_{1L}$, $5_{1R}$, the lower end of the pipe 22 can be formed into a flattened shape.

An oil drain recess $5_2$ is integrally formed on the right side surface of the extension case 5 at a position upwardly of the right mount receiving recess $5_{1R}$ and this oil drain recess $5_2$ is covered with an upwardly extending portion $36_1$ which is formed integrally on an upper portion of the right cover 36. Thus, the right mount receiving recess $5_{1R}$ and the oil drain recess $5_2$ are covered with common right cover 36 so that the number of components can be reduced in this arrangement.

An opening $5_3$ is formed at an upper wall of the oil drain recess $5_2$ and a lower end portion of the oil pan 21 is fitted in this opening $5_3$ via a seal member 37 interposed therebetween. The seal member 37 serves to prevent the exhaust gas, which has been discharged from the exhaust pipe 24 to the inside of the extension case 5, from leaking into the oil drain recess $5_2$ through between the opening $5_3$ and the lower end portion of the oil pan 21. At the lower end portion of the oil pan 21 there are further provided a bolt hole $21_2$ which extends laterally through the wall surface of the oil pan 21 and a drain passage $21_3$ extending vertically so as to be connected at its upper end with the bolt hole $21_2$ and at its lower end with the outside of the oil pan 21.

A seal seat $21_4$ is formed at an inner end of the bolt hole $21_2$ and the drain passage $21_3$ is openably closed by tightening a drain bolt 38 as a drain passage opening and closing means into the bolt hole $21_2$ from the right side surface of the extension case 5. A head portion $38_1$ of the drain bolt 38 as an operating portion is opposed to an opening $5_4$ formed on the right side surface of the extension case 5 and this opening $5_4$ can be closed with a rubber cap 39 for preventing leakage of the exhaust gas therethrough. In a state in which the right cover 36 is mounted in position, its upwardly extending portion $36_1$ faces the outside surface of the cap 39 whereby the cap 39 is prevented from falling off. A hose joint 40 as a pipe portion is press-fitted at its upper end into a lower end of the drain passage $21_3$ and the lower end of the hose joint 40 is bent at an angle at its intermediate portion so as to facilitate guiding of a hose 41 toward the right side surface of the extension case 5 when the hose 41 is to be connected to the lower end of the hose joint 40.

The upper side oil drain recess $5_2$ and the lower side mount receiving recess $5_{1R}$, which are formed integrally on the right side surface of the extension case 5, are located adjacently to each other in a vertical direction with a common partition wall $5_5$ interposed therebetween and both the recesses are open to the right side surface of the extension case 5. Hence at the time of casting the extension case 5, one of two laterally divided die parts can be used to form the mount receiving recess $5_{1R}$ and the oil drain recess $5_2$ simultaneously. Since the mount receiving recess $5_{1R}$ and the oil drain recess $5_2$ are located adjacently in a vertical direction, not only can the thickness of the partition wall $5_5$ be small to prevent generation of any surplus cast portion, but also the volume of the oil pan 21 can be made sufficiently large by lowering the position of the drain passage $21_3$ provided at the lower end of the oil pan 21.

As is apparent from FIG. 3, the length of the oil drain recess $5_2$ in the front-and-rear direction is less than that of the mount receiving recess $5_{1R}$. More specifically, the rear end of the oil drain recess $5_2$ is formed flush with the rear end of the mount receiving recess $5_{1R}$, whereas the front end of the oil drain recess $5_2$ is terminated in the vicinity of a central position of the mount receiving recess $5_{1R}$ in the front-and-rear direction. As apparent from FIG. 2, a bottom wall $5_6$ of the oil drain recess $5_2$ is laterally offset to an inner side than a bottom wall $5_7$ of the mount receiving recess $5_{1R}$ (closer to the center line CL of the outboard engine structure O).

It should be noted that in casting the extension case 5, two core members are disposed on upper side and lower side, respectively, within a cavity defined by two casting die parts which are divided into left and right sides. The configuration of the core members can be simplified and generation of any surplus portion in a cast product can be prevented by setting the mating surfaces of the upper and lower core members at a location corresponding to the partition wall $5_5$ which separates the mount receiving recess $5_{1R}$ and the oil drain recess $5_2$. In other words, the bottom wall $5_7$ of the mount receiving recess $5_{1R}$ and the bottom wall $5_6$ of the oil drain recess $5_2$ are connected together via the partition wall $5_5$ with a step provided therebetween in the lateral direction (see FIG. 2). Moreover, the length of the oil drain recess $5_2$ in the front-and-rear direction which is formed on the upper side of the partition wall $5_5$ is shorter than that of the mount receiving recess $5_{1R}$. This arrangement enables an obtained extension case 5 as a cast product to be separated from the die parts by dividing and removing the core members at a location corresponding to the partition wall $5_5$.

In draining the oil stored in the oil pan 21 to the outside, the outboard engine structure O is first pivoted and tilted around the tilt shaft 15 up to the chain position of FIG. 1 and in this state the outboard engine structure O is steered around the swivel shaft 17 to one lateral side, i.e., rightwardly, whereby the right side surface of the extension case 5 of the outboard engine structure O is brought to a position facing the ship body g side and downwardly. In this state the two bolts 35, 35 are loosened and the right cover 36 on the right side surface of the extension case 5 is removed to permit the oil drain recess $5_2$ to be exposed to the outside and thereafter the cap 39 is removed to permit the head portion $38_1$ of the drain bolt 38 to be exposed to the outside. Then the hose joint 40 disposed within the oil drain recess $5_2$ is connected to an oil drain tank, not shown, via the hose 41 and thereafter, the head portion $38_1$ is operated to loosen the drain bolt 38 so that the tip of the drain bolt 38 is moved away from the seal seat $21_4$.

As a result, the oil within the oil pan 21 flows out through a path formed of the drain passage $21_3$, hose joint 40 and hose 41 and thus, without adhering to the outboard engine structure O, is discharged to the oil drain tank. Since, during this operation, the right side surface of the extension case 5 is directed downwardly by the tilting up and steering of the outboard engine structure O, any oil leaked out from connected portions of the hose 41 can be drained to the outside reliably without adhering to the oil drain recesss $5_2$. Furthermore, one inclined portion $21_5$ (see FIG. 3) and another inclined portion $21_6$ (see FIG. 2) are formed at a lower portion of the oil pan 21, so that the oil can be discharged completely to the outside without remaining within the oil pan 21.

Since the head portion $38_1$ of the drain bolt 38 is directed rightwardly toward the opening of the oil drain recess $5_2$, when an operator loosens or unscrews the head portion $38_1$ of the bolt 38 for draining the oil in the above-mentioned manner, the tool can be handled extremely easily. Moreover, since the oil within the oil pan 21 flows through the drain passage $21_3$ and hose joint 40 on the side remote from the head portion $38_1$ of the bolt 38, the oil does not contaminate the tool at the time of unscrewing the bolt 38.

Furthermore, owing to the arrangement that the oil drain recess $5_2$ in which the hose joint 40 and the drain bolt 38 are accommodated is provided on one side surface of the extension case 5, the draining of oil can be conducted by an operator who is on board the ship at the time of maintenance of the engine E, for example, by steering the outboard engine structure O to the right and directing the oil drain recess 5 2 to the ship body g side. This eliminates the need for the operator to go down to the ground or on shore and to a place near the outboard engine structure O. In addition, since the oil drain recess $5_2$ is located at a substantially central position on the right side surface of the extension case 5 in the front-and-rear direction, when the outboard engine structure O is steered to the right side and the oil drain recess $5_2$ is directed to the ship body S side, there are no such inconveniences encountered in the maintenance that the recess $5_2$ comes to a position too close to the swivel case 16 making the operation difficult to be done or the recess $5_2$ is distanced far from the ship body S thereby making the operation difficult. Furthemore, since the hose joint 40 and the drain bolt 38 are disposed on the same side of the extension case 5, the oil draining operation can be finished without changing the posture of the outboard engine structure O. This makes the operation efficiency very good.

A second embodiment according to the invention will next be described with reference to FIGS. 4–8.

Figure 4:
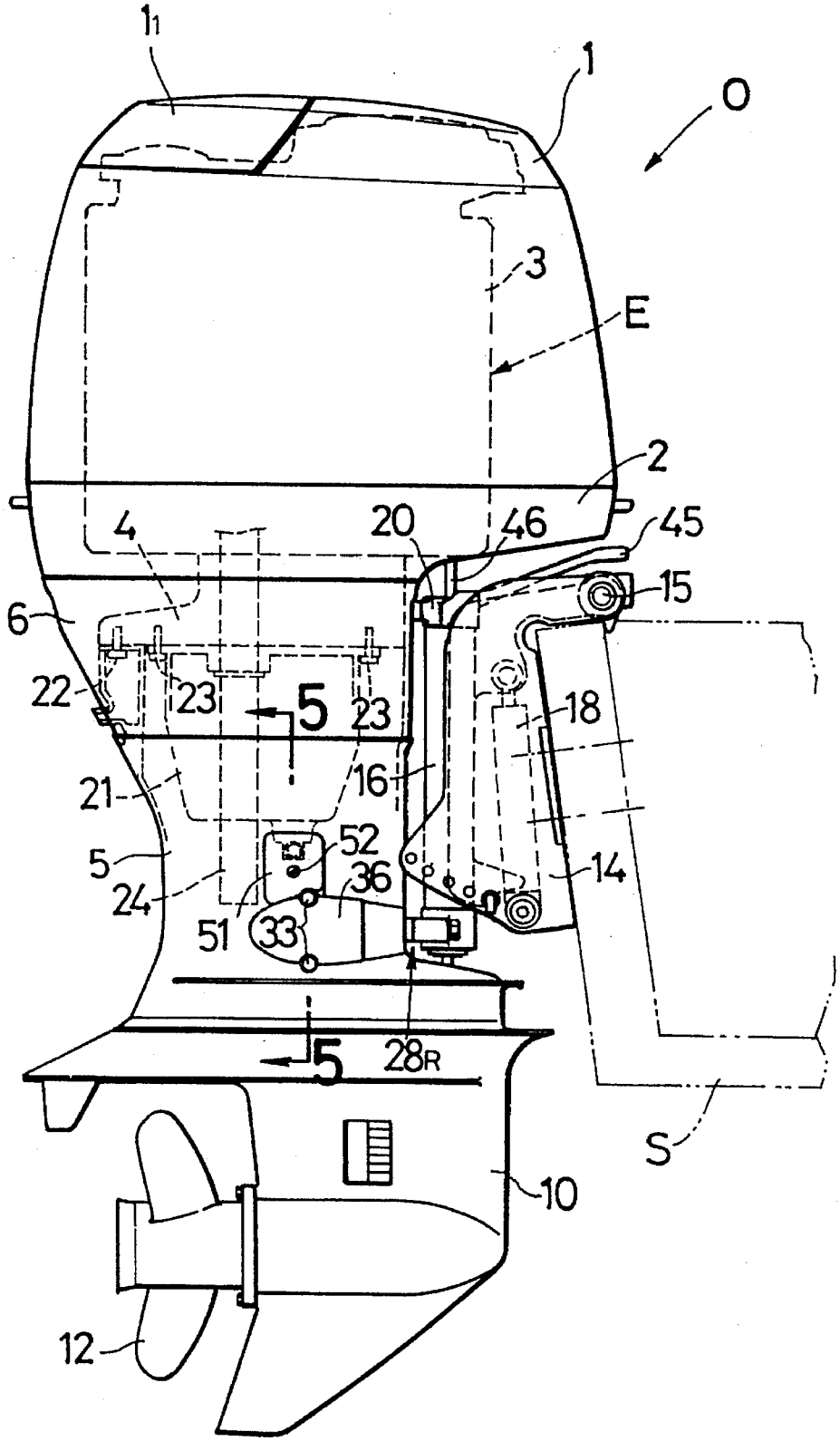

As apparent from FIG. 4, the whole arrangement of the outboard engine structure according to this second embodiment is generally identical to that of the first embodiment and so elements corresponding to those of the first embodiment will be denoted with the same reference numerals and characters.

In this embodiment, an engine E, a joint member 4, an extension case 5 and a gear case 10 are laid one on another in a vertical direction. The engine E, joint member 4 and an upper portion of the extension case 5 are covered with an engine cover 1, an under case 2 and an under cover 6. Incidentally, reference numeral $1_1$ in the drawings designates an air inlet opening, 45 does a connection for a steering cable and 26 does a shift rod. Moreover, reference numeral 47 in FIG. 5 indicates a bolt for fixing an exhaust pipe 22 to a bulged flange portion of an oil pan 21.

As shown in FIGS. 5–8, a pair of lower mounts $28_L$, $28_R$ are provided to resiliently carry the extension case 5 at left and right side surfaces thereof on a stay 29 at a lower end of a swivel shaft 17 and rubber bushes $32_L$, $32_R$ of the lower mounts $28_L$, $28_R$ are fitted in mount receiving recesses $5_{1L}$, $5_{1R}$ which are provided in a depressed fashion on the left and right side surfaces of the extension case 5. Openings defined by the recesses are respectively covered with left cover 34 and right cover 36 which are fixed to the extension case 5 detachably by respective two bolts 33, 33.

At a position upwardly of the mount receiving recess $5_{1R}$ provided on the right side surface of the extension case 5 there is formed an oil drain recess $5_2$ in an integral fashion like the first embodiment. The oil drain recess $5_2$ is covered with a detachable cover 51 which is formed as a member separate from the above-mentioned right cover 36. A bolt hole $5_8$ into which a bolt 52 is threaded for fixing the cover 51 is formed in a boss $5_9$ protruded inside the oil drain recess $5_2$. The bolt hole $5_8$ is formed parallel to two bolt holes $5_{10}$, $5_{10}$ which are provided at a peripheral edge of the mount receiving recess $5_{1R}$ for holding the right cover 36 in position. This arrangement enables the mentioned three bolt holes $5_8$, $5_{10}$, $5_{10}$ to be processed in the same direction and, if desired, the holes may be processed at the same time in one operation, thus contributing to an enhanced processibility.

The oil pan 21 is fitted via a seal member 37 in an opening $5_3$ formed at the oil drain recess $5_2$. The oil pan 21 is provided with a bolt hole $21_2$ which also serves as a drain passage $21_3$. A drain bolt 38 is threaded into the bolt hole $21_2$ thereby occluding the drain passage $21_3$. The drain bolt 38 is arranged with its head portion $38_1$ being directed rightwardly toward the opening of the oil drain recess $5_2$ so as to facilitate the operation with a tool. Downwardly of the oil drain recess $5_2$ there is provided an oil receiver $5_{11}$ in a projected manner while surrounding the boss $5_9$ so as to define a U-shape as seen in a side view.

Also in this second embodiment, the oil drain recess $5_2$ on the upper side and the mount receiving recess $5_{1R}$ on the lower side are formed adjacently to each other in a vertical direction on the right side surface of the extension case 5 with a thin partition wall $5_5$ interposed therebetween. Hence, such advantages are obtainable therefrom that at the time of casting the extension case 5, not only can the mount receiving recess $5_{1R}$ and the oil drain recess $5_2$ be formed simultaneously with use of one of two die parts which are divided into left and right ones at a split or separation plane indicated by reference numeral $P_1$ in FIG. 5, but also generation of any surplus cast wall portion is prevented to a possible degree between the mount receiving recess $5_{1R}$ and the oil drain recess $5_2$ and moreover, the position of the drain passage $21_3$ can be lowered to allow an increase in the volume of the oil pan 21 .

Figure 5:
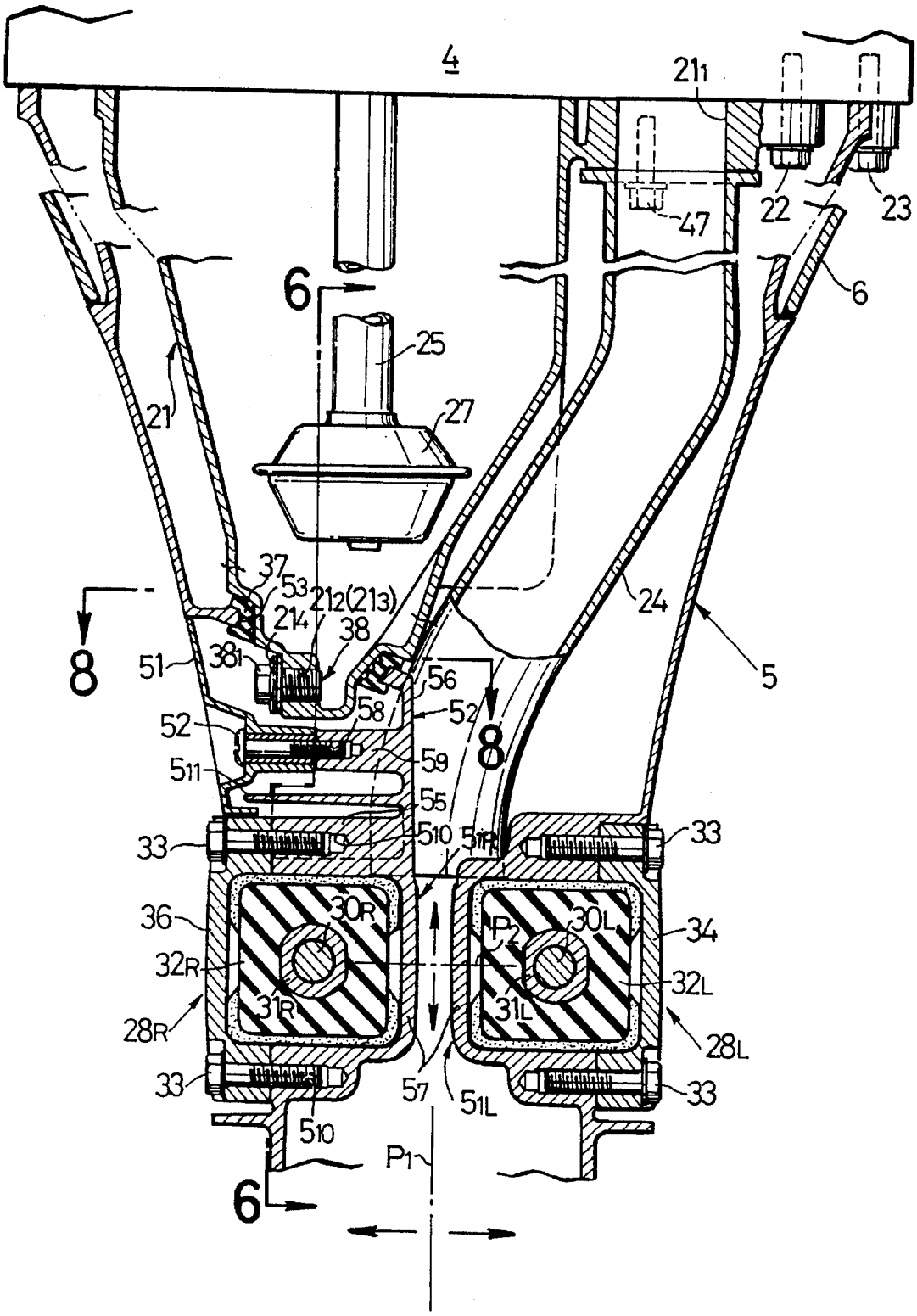
Figure 6:
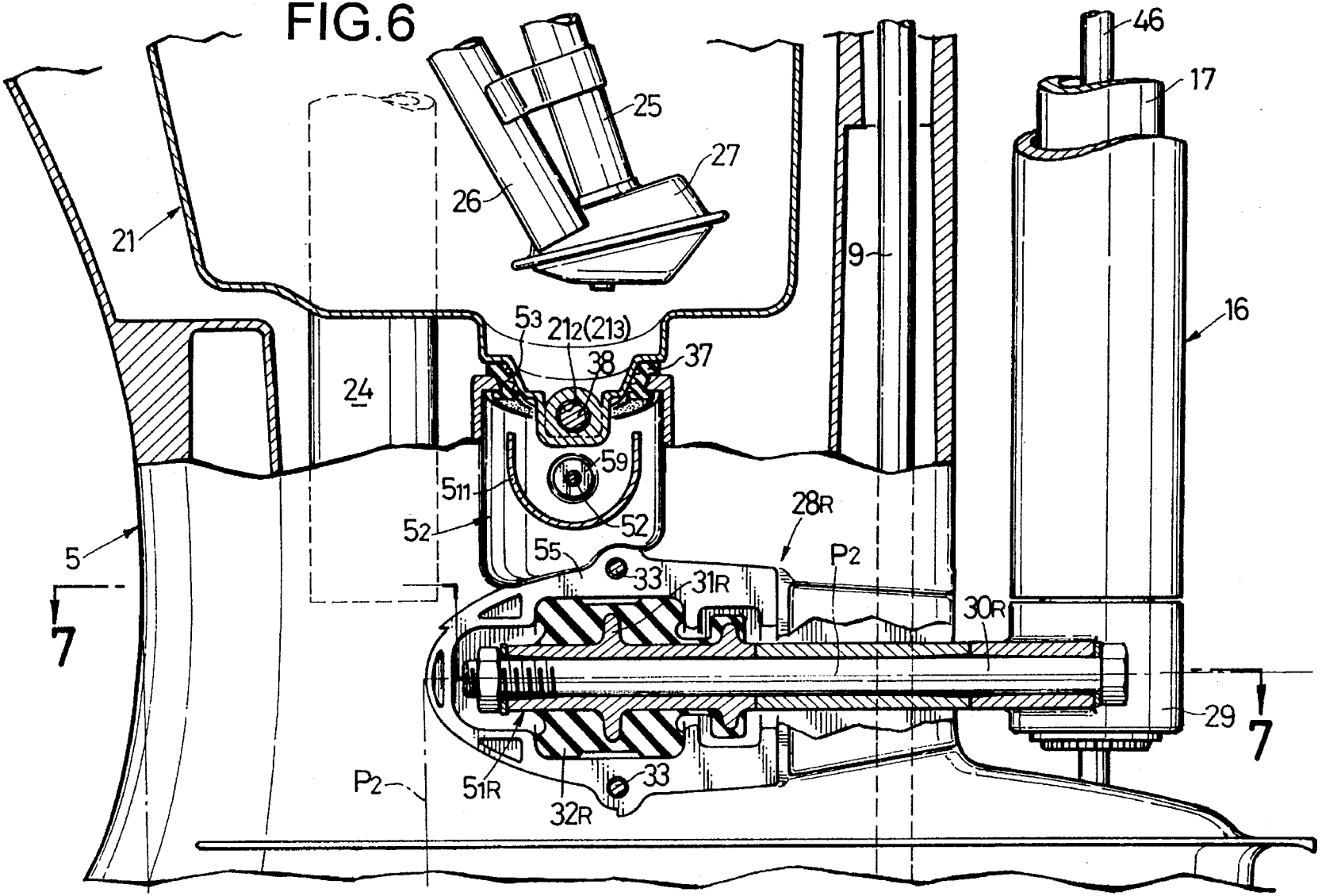
Figure 7:
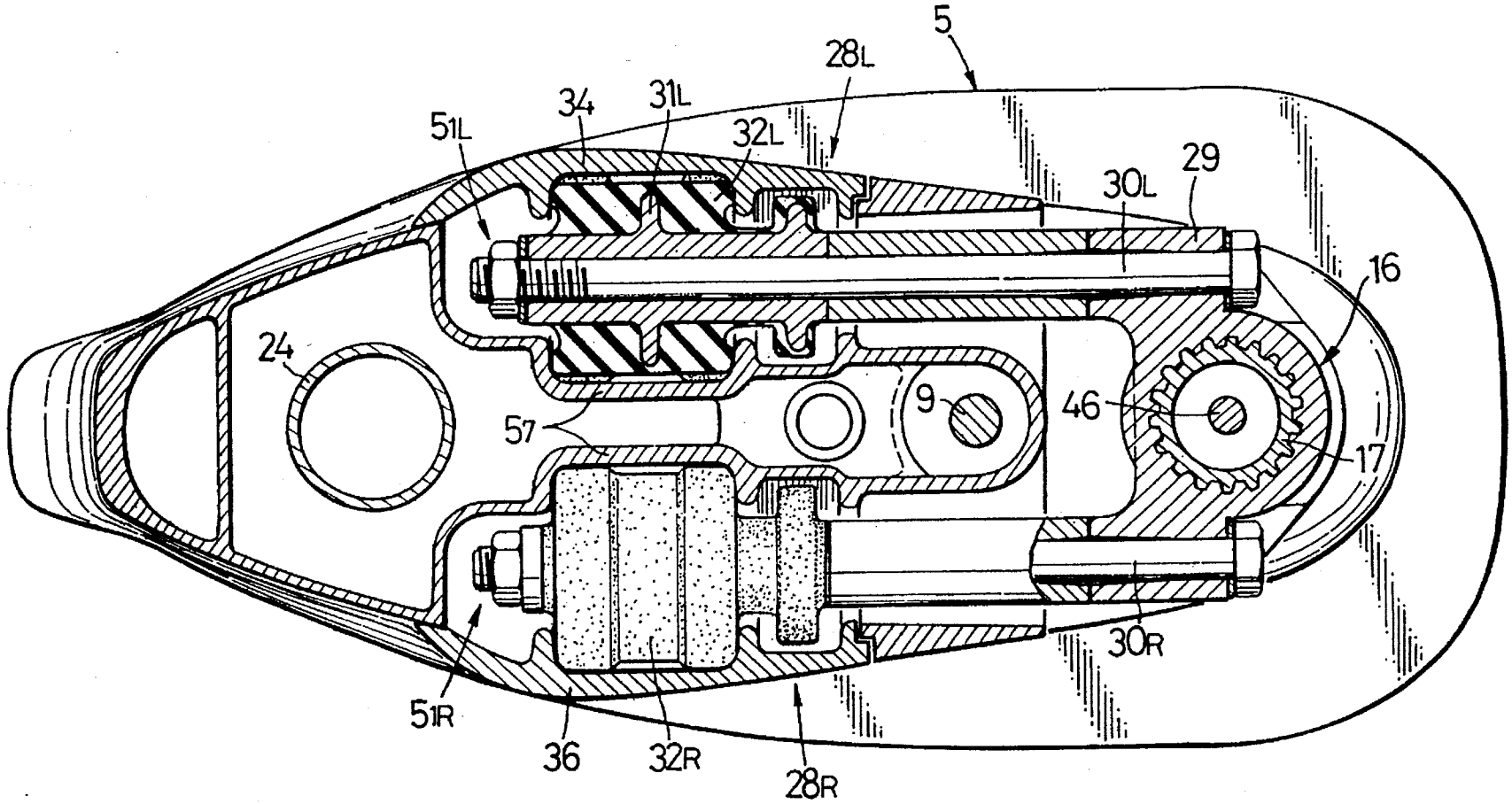
Figure 8:
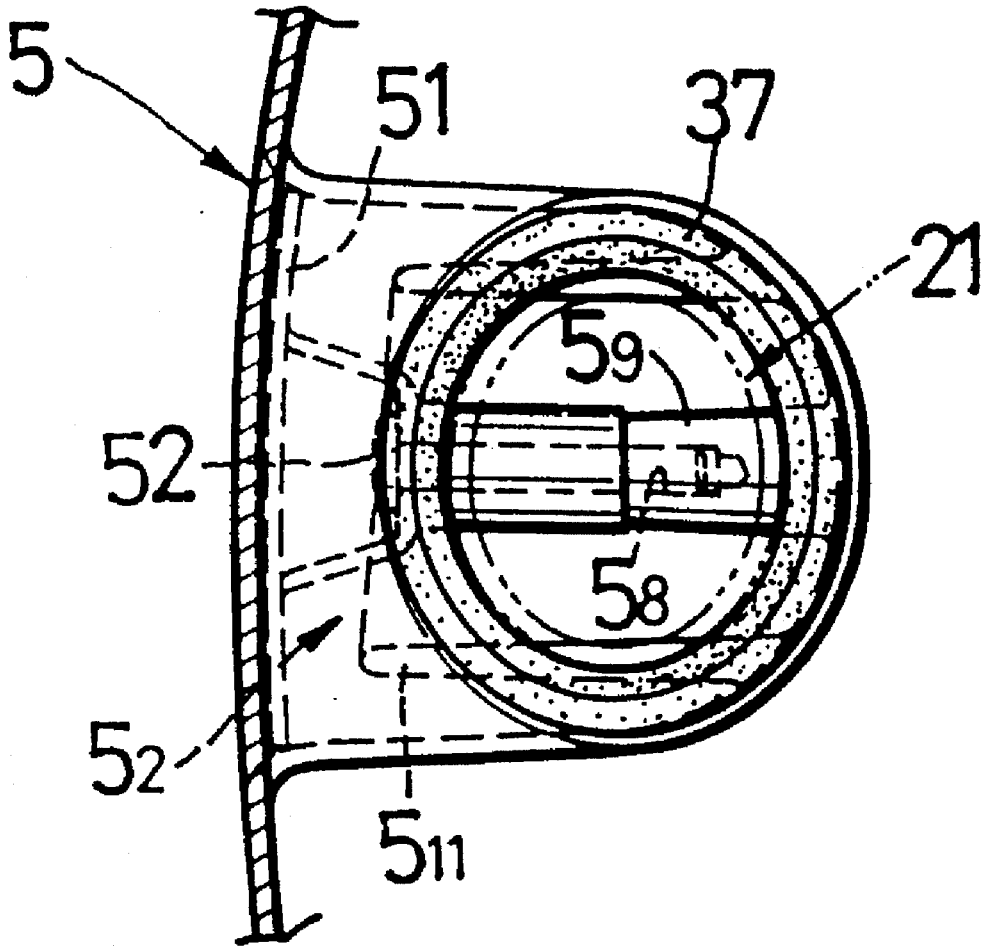

The length of the oil drain recess $5_2$ in the front-and-rear direction is determined so as to stay within the range of the length of the mount receiving recess $5_{1R}$ in the same direction (see FIG. 6) and a bottom wall $5_6$ of the oil drain recess $5_2$ is formed substantially flush with a bottom wall $5_7$ of the mount receiving recess $5_{1R}$ as seen in a front view (see FIG. 5). Accordingly, when producing the extension case 5 by casting, it is only required to divide two core members, which are divided into an upper side one and a lower side one and disposed inside a die formed of left and right two parts, at a split or separation plane $P_2$ which passes an appropriate location corresponding to the bottom wall $5_6$ of the oil drain recess $5_2$ or the bottom wall $5_7$ of the mount receiving recess $5_{1R}$ (a horizontal plane passing the left and right bolts $30_L$, $30_R$ in this embodiment), for taking out a cast product from the die parts.

It should be noted that in the illustrated embodiment the split plane $P_2$ is bent downwardly at a position rearwardly of the mount receiving recesses $5_{1L}$, $5_{1R}$ in view of the molding operation for portions other than the mount receiving recesses $5_{1L}$, $5_{1R}$. However, the split plane $P_2$ can be formed as a single plane extending horizontally in the whole, of course.

The present invention has been described above in connection with some embodiments, however, it should not be limited thereto and various modifications can be made in design.

For example, though the oil drain recess $5_2$ is provided on the right side surface of the extension case 5 in the embodiments, it may be made on the left side surface. Furthermore, means for opening and closing the drain passage $21_3$ is not limited to the drain bolt 38 and can be any other means such as an opening and closing valve.

What is claimed is:

1. An outboard engine structure comprising an engine, a case for carrying said engine on an upper portion thereof, an oil pan which is accommodated inside an extension case forming at least a part of said case and stores oil for lubricating said engine, a drain passage for draining the oil from said oil pan, a drain passage opening and closing means for opening and closing said drain passage, and a pair of left and right mounts for carrying said extension case on a swivel case against vibration, wherein a mount receiving recess for receiving at least a part of one of said left and right mounts and an oil drain recess to which said drain passage opening and closing means is exposed are formed adjacent to each other and opened in the same direction on a side surface on one of left and right sides of said extension case, and wherein said oil drain recess and said mount receiving recess for said one of the left and right mounts are disposed adjacently to each other in a vertical direction with a common partition wall interposed therebetween.

2. An outboard engine structure according to claim 1, wherein said oil drain recess is formed within a range of a width of said mount receiving recess for said one of the left and right mounts in a front-and-rear direction as seen in a side view.

3. An outboard engine structure according to claim 1, wherein said oil drain recess has a bottom wall which is situated at a position closer to a lateral center line of said extension case than a bottom wall of said mount receiving recess as seen in a front view.

4. An outboard engine structure according to claim 1, wherein a bottom wall of said oil drain recess and a bottom wall of said mount receiving recess are formed substantially flush with each other as seen in a front view.

5. An outboard engine structure according to claim 1, wherein said drain passage opening and closing means is a drain bolt and a head portion of said drain bolt is directed generally outwardly within said oil drain recess in a lateral direction.

6. An outboard engine structure according to claim 1, wherein an end portion of said drain passage opens into said oil drain recess.

7. An outboard engine structure according to claim 1, wherein an end portion of said drain passage is formed as a pipe portion.

8. An outboard engine structure according to claim 7, wherein said drain passage opening and closing means is disposed upstream of said pipe portion.

9. An outboard engine structure according to claim 1 , wherein said mount receiving recess and said oil drain recess are covered with a common cover.

10. An outboard engine structure according to claim 1, wherein a cover for covering said mount receiving recess and a cover for covering said oil drain recess are provided separately and bolt holes for fixing these covers to said extension case are formed parallel to each other.

11. An outboard engine structure comprising an engine, a case for carrying the engine, an oil pan for storing oil from said oil pan, and a drain passage for draining the oil from said oil pan, and a drain passage opening and closing means for opening and closing said drain passage, wherein an oil drain recess is formed in said case in an inwardly recessed manner, and an operating portion for operating said drain passage opening and closing means is disposed inside said oil drain recess at a position remote from a path through which the oil to be drained from said drain passage flows.

12. An outboard engine structure according to claim 11, wherein said case includes an extension case which is to be carried on a ship body in such a manner that the extension case is capable of tilting up and down and being steered to left and right, wherein said oil drain recess is formed on a side surface on one of left and right sides of said extension case, and said drain passage is disposed in said oil drain recess.

13. An outboard engine structure according to claim 12, wherein said operating portion for said drain passage opening and closing means is disposed on said side surface on which said oil drain recess is formed.

14. An outboard engine structure according to claim 11, wherein said drain passage opening and closing means is a drain bolt and a head portion of said drain bolt is directed generally outwardly within said oil drain recess in a lateral direction.

15. An outboard engine structure according to claim 11, wherein an end portion of said drain parage opens into said oil drain recess.

16. An outboard engine structure according to claim 11, wherein an end portion of said drain passage is formed as a pipe portion.

17. An outboard engine structure according to claim 16, wherein said drain passage opening and closing means is disposed upstream of said pipe portion.

18. An outboard engine structure according to claim 11, wherein said mount receiving recess and said oil drain recess are covered with a common cover.

19. An outboard engine structure comprising an engine, a case for carrying said engine on an upper portion thereof, an oil pan which is accommodated inside an extension case forming at least a part of said case and stores oil for lubricating said engine, a drain passage for draining the oil from said oil pan, a drain passage opening and closing means for opening and closing said drain passage, and a pair of left and right mounts for carrying said extension case on a swivel case against vibration, wherein a mount receiving recess for receiving at least a part of one of said left and right mounts and an oil drain recess to which said drain passage opening and closing means is exposed are formed and opened in the same direction on a side surface on one of left and right sides of said extension case, and wherein said oil drain recess is formed within a range of a width of said mount receiving recess for said one of the left and right mounts in a front-and-rear direction as seen in a side view.

20. An outboard engine structure according to claim 19, wherein said oil drain recess has a bottom wall which is situated at a position closer to a lateral center line of said extension case than a bottom wall of said mount receiving recess as seen in a front view.

21. An outboard engine structure according to claim 19, wherein said mount receiving recess and said oil drain recess are covered with a common cover.

22. An outboard engine structure according to claim 19, wherein said engine has an exhaust passage, and an exhaust pipe is disposed inside said extension case, said exhaust passage being connected to said exhaust pipe at a position laterally offset to a side opposite said side surface where said oil drain recess is provided.

23. An outboard engine structure comprising an engine, an oil pan for storing oil lubricating said engine, a drain passage for draining the oil from said oil pan, and a drain passage opening and closing means for opening and closing said drain passage, wherein an operating portion for operating said drain passage opening and closing means is disposed at a position remote from a path through which the oil to be drained from said drain passage flows, wherein an extension case is provided which is to be carried on a ship body by means of a pair of left and right mounts in such a manner that the extension case is capable of tilting up and down and being steered to left and right, wherein said drain passage is disposed in an oil drain recess which is formed on a side surface on one of left and right sides of said extension case while a mount receiving recess is formed on said side surface of said extension case for receiving at least a part of one of said pair of mounts.

24. An outboard engine structure according to claim 23, wherein said operating portion for said drain passage opening and closing means is disposed on said side surface on which said oil drain recess is formed.

25. An outboard engine structure according to claim 11 or 23, wherein a cover for covering said mount receiving recess and a cover for covering said oil drain recess are provided separately and bolt holes for fixing these covers to said extension case are formed parallel to each other.

26. An outboard engine structure comprising an engine, a case for carrying said engine on an upper portion thereof, an oil pan which is accommodated inside an extension case forming at least a part of said case and stores oil for lubricating said engine, a drain passage for draining the oil from said oil pan, a drain passage opening and closing means for opening and closing said drain passage, and a pair of left and right mounts for carrying said extension case on a swivel case against vibration, wherein a mount receiving recess for receiving at least a part of one of said left and right mounts and an oil drain recess to which said drain passage opening and closing means is exposed are formed and opened in the same direction on a side surface on one of left and right sides of said extension case, said mount receiving recess and said oil drain recess being formed in an inwardly recessed manner from a plane defined by said side surface of the extension case.

* * * * *